US007810262B2

(12) United States Patent
Sadon

(10) Patent No.: US 7,810,262 B2
(45) Date of Patent: Oct. 12, 2010

(54) SOLAR POWERED LED ILLUMINATED ALPHANUMERIC DISPLAY

(76) Inventor: Eli Sadon, 10966 Rondelay Dr., St. Louis, MO (US) 63141

( * ) Notice: Subject to any disclaimer, the term of this patent is extended or adjusted under 35 U.S.C. 154(b) by 110 days.

(21) Appl. No.: 12/076,340

(22) Filed: Mar. 17, 2008

(65) Prior Publication Data

US 2009/0229154 A1 Sep. 17, 2009

(51) Int. Cl.
*G09F 13/18* (2006.01)

(52) U.S. Cl. ..... 40/546; 40/575; 40/576; 40/490

(58) Field of Classification Search ..... 40/546, 40/576, 575, 617; 362/634, 633, 632, 605
See application file for complete search history.

(56) References Cited

U.S. PATENT DOCUMENTS

| | | | | |
|---|---|---|---|---|
| 3,402,493 | A * | 9/1968 | Mellyn et al. | 40/563 |
| 4,532,579 | A | 7/1985 | Merryman | |
| 4,765,080 | A * | 8/1988 | Conti | 40/576 |
| 4,848,017 | A | 7/1989 | Bailey et al. | |
| 4,903,172 | A * | 2/1990 | Schoniger et al. | 362/612 |
| 5,020,253 | A | 6/1991 | Lie et al. | |
| 5,911,524 | A | 6/1999 | Wilton | |
| 5,950,340 | A * | 9/1999 | Woo | 40/564 |
| 6,305,109 | B1 * | 10/2001 | Lee | 40/546 |
| 6,539,657 | B1 | 4/2003 | Qualls, Jr. et al. | |
| 6,568,109 | B2 | 5/2003 | Sanders | |
| 6,745,507 | B2 | 6/2004 | Golding | |
| 6,860,629 | B2 | 3/2005 | Velez | |
| 6,948,826 | B2 | 9/2005 | Fogerlie | |
| 6,964,366 | B2 | 11/2005 | Peng et al. | |
| 6,994,448 | B1 | 2/2006 | Gorrell | |
| 7,036,255 | B1 | 5/2006 | Santana et al. | |
| 2002/0093832 | A1 | 7/2002 | Hamilton | |
| 2003/0079387 | A1 | 5/2003 | Derose | |
| 2004/0216343 | A1 | 11/2004 | Golding | |
| 2005/0160644 | A1 * | 7/2005 | Yang et al. | 40/546 |
| 2006/0164827 | A1 | 7/2006 | Minewiser et al. | |
| 2006/0274521 | A1 | 12/2006 | Ullrich | |

FOREIGN PATENT DOCUMENTS

| | | | |
|---|---|---|---|
| CA | 2 287 629 | A1 | 4/2001 |
| DE | 37 15 943 | A1 | 12/1988 |
| KR | 20-0239598 | Y1 | 10/2001 |
| WO | WO-90/07173 | A1 | 6/1990 |

* cited by examiner

*Primary Examiner*—Lesley Morris
*Assistant Examiner*—Christopher E Veraa
(74) *Attorney, Agent, or Firm*—Birch, Stewart, Kolasch & Birch, LLP

(57) ABSTRACT

A lighted display for an address indication. The display includes a housing with a solar panel on top and a depending acrylic panel having numbers and letters etched thereon. The housing includes a rechargeable battery and appropriate electronics. A series of LEDs provided above the acrylic panel light the display. The panel includes grooves on the side of the top which interact with projections on the bottom of the housing which allow the panels to slide into place. A channel on the top of the panel receives the LEDs. The solar panel is preferably angled to receive more light and to shed water.

14 Claims, 4 Drawing Sheets

SOLAR POWERED LED ILLUMINATED ALPHANUMERIC DISPLAY

BACKGROUND OF THE INVENTION

The present invention relates to an illuminated display for alphanumeric characters and in particular to a solar powered illuminated display for house numbers using LEDs and one or more rechargeable batteries.

DESCRIPTION OF THE BACKGROUND

Lighted displays are a common expedient for displaying various information about a building, such as the street address. Furthermore, displays are sometimes also used for advertising purposes for businesses. It is important that a light be present so that the information can be easily ascertained after dark. Initially this was accomplished merely by receiving power from the electrical system of the house. More recently solar power units have been developed which allow the power to be applied in such a manner that it is not necessary to provide wiring from the building.

However, the amount of power that is producible by a small solar panel limits the amount of light that is produced for the display. Using traditional incandescent bulbs are difficult under these power conditions. Other systems which use less power are sometimes used. However these are often not well lit also. Further, it is desirable to have units which are small and easily mounted and which have alphanumeric characters which are easily replaced.

U.S. Published Patent Application 2004/0216343 shows an address illumination assembly having a series of alphanumeric elements in a display. A solar panel is provided which along with a rechargeable battery, provides power to light emitting diodes for illuminating the alphanumeric characters. Separate alphanumeric characters can be carved or etched in the surface of a flat plate-like member made of acrylic, polycarbonate, glass, epoxy or resin. Since the plate is clear, a light passes therethrough. However the etched portion is opaque when lighted. The individual modules are placed together in an assembly and held by end elements at the right and left ends.

U.S. Published Patent Application 2003/0079387 describes a lighted sign using etched acrylic panels having various symbols such as alphanumerics. Light emitting diodes are provided to light panels. The acrylic panel lies vertically between an upper and lower rail which contains the LEDs.

German Patent DE3715943 shows an illuminated display unit for a house number having solar cells on top of the housing and light emitting diodes for illumination.

While the prior art devices provide workable illuminated displays, further advances are desirable in the arrangement of the displays so as to have a housing which is small and light, which operates with low power requirements, which is attractive and which can be sealed from the elements easily.

SUMMARY OF THE INVENTION

Accordingly, the present invention provides for a solar powered illuminated display using light emitting diodes which operate with low power requirements.

The present invention further provides an illuminated display which is small and easily mounted, which is attractive and easily sealed for protection from the elements.

The present invention also provides an illuminated display using acrylic panels which easily slide into position so as to hang downwardly from the housing and which receive eliminating diodes in a channel along a top of the panels.

The present invention still further provides for a compact lightweight, easily mountable housing which can be sealed from the elements with the alphanumeric display panels hanging down from the housing.

The present invention also provides for a solar powered, LED illuminated display having a compact housing with alphanumeric characters mounted on panels which hang downwardly from the housing in such a manner as to effectively use light produced by the LEDs.

The present invention also provides a housing for a lighted display where guides form a channel for sliding alphanumeric panels into place.

Briefly, the present invention is achieved by providing a housing having a front, back, two ends and a bottom with the top being formed by a power panel. The housing includes one or more rechargeable batteries, electronics and light emitting diodes to produce the light. The bottom portion of the housing includes guides made with projections on which acrylic panels having grooves are slid into the position. The panels have a top channel into which the LEDs can be placed for effective use of the light.

BRIEF DESCRIPTION OF THE DRAWINGS

A more complete depreciation of the invention and many of the attendant advantages thereof will be readily obtained as the same becomes better understood by reference to the following detailed description when considered in connection with the accompanying drawings, wherein.

THE DESCRIPTION OF THE PREFERRED EMBODIMENTS

Figure 1:
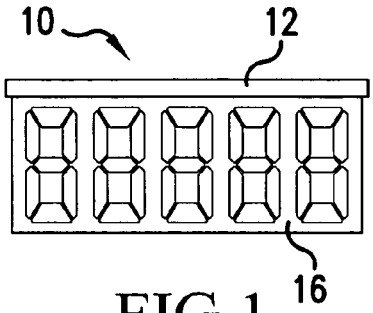
FIG. 1 is a front view of a simplified version of the present invention.

Turning now to the drawings, where like reference numerals designate identical or corresponding parts throughout the several views, and more particularly to FIG. 1 thereof, wherein FIG. 1 shows a simplified version of the present invention. The display panel includes a housing 12 and an acrylic panel 16 which hangs down from the housing. The panel shows five digits etched in the panel. However, any number of digits or alphabetic characters or other symbols could be used as desired. It would also be possible to use other non-alphanumeric symbols for display purposes which, for example, will indicate the business located there or merely for ornamental purposes. While the panel 16 is shown in this embodiment as a single panel, separate individual panels may be used for each alphanumeric character so that, for example, a purchaser may individually buy pre-etched prepared numbers to match their existing house number rather than having the panel individually prepared, thus lowering the cost and time necessary per purchase. While the alphanumeric characters have been described as being etched in the panel, it is understood that other processes could be used to form the alphanumeric characters in the panel, including, for example, engraving.

Figure 2:
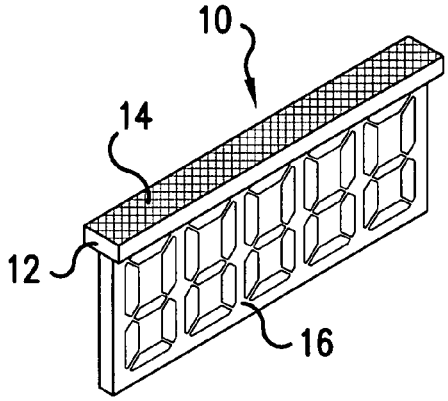
FIG. 2 is a perspective view of the embodiment shown in FIG. 1.

FIG. 2 shows a perspective view of the same display 10. A solar panel 14 is shown as being mounted on the top of the housing 12 powering the display. The individual characters formed in the acrylic panel 16 may be etched or engraved or otherwise formed in any fashion which causes these areas to be illuminated when light travels therethrough as opposed to the main part of the panel which remains transparent.

Although not seen, the housing 12 incorporates one or more rechargeable batteries for storing power generated by the solar panel and necessary electronics for processing the power. The electronics are connected to a plurality of light emitting diodes which are mounted in the housing and directed downwardly into the acrylic panel. Light from the light emitting diodes strikes the panel and illuminates the alphanumeric characters which are etched therein. Since the housing 12 does not include the panels, it can be formed as a small, compact, light weight and easily mountable structure.

Although not easily seen in this figure, the acrylic panel 16 is mounted on the bottom of the housing in a grooved arrangement so that the panel may slide into position.

Figure 3:
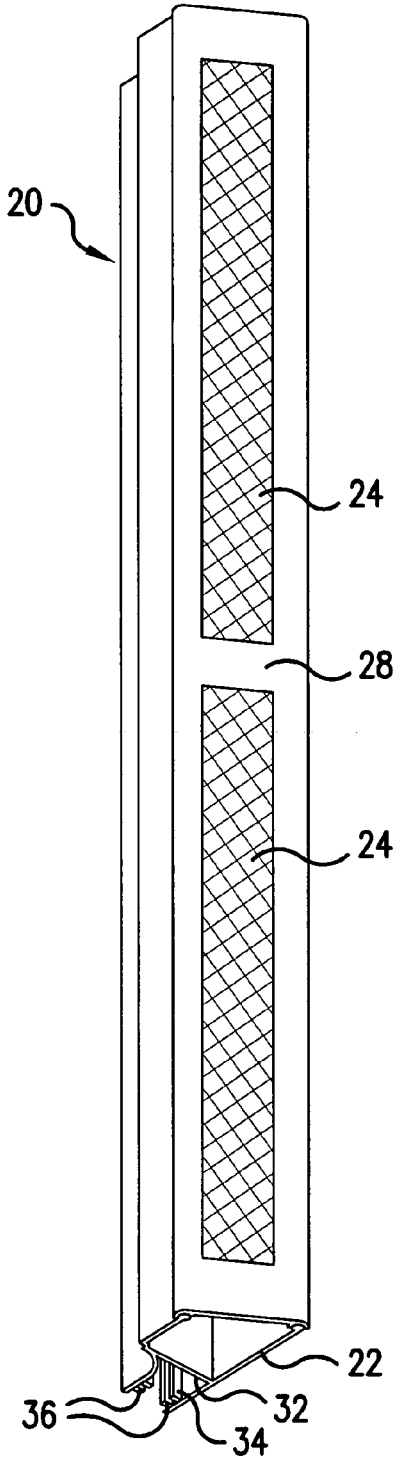
FIG. 3 is a perspective view of the main embodiment of the present invention.

FIG. 3 is a perspective view of the main embodiment 20 of the present invention. The housing 22 is formed as an elongated box with a top 28 mounted at an angle on which solar panels 24 are mounted. The housing includes a back panel 23 which is generally flat for mounting the device on a surface. A front panel is also provided which may be at least partially flat, but may be shaped to make a more attractive appearance. The top 28 is mounted on the front and back panels in such a manner as to be firmly attached such as by snap fit arrangement. Alternatively, the device may be attached by adhesive, hinging or by permanent fasteners such as screws. An end plate may be provided for each end which may be attached by similar fashion. A preferred method is to use small screws which are inserted into the circular openings at the top and bottom of the front and back panel. A floor 32 extends from the front panel to the back panel within the housing. Although shown in FIG. 3 as a simple bar, to better show the projections, in fact the embodiment has a solid floor extending the length of the housing. This provides a sealable enclosure for receiving the electronics and also provides better mechanical support of the device. This also provides a mounting location for the LED's directly above the panels.

Figure 4:
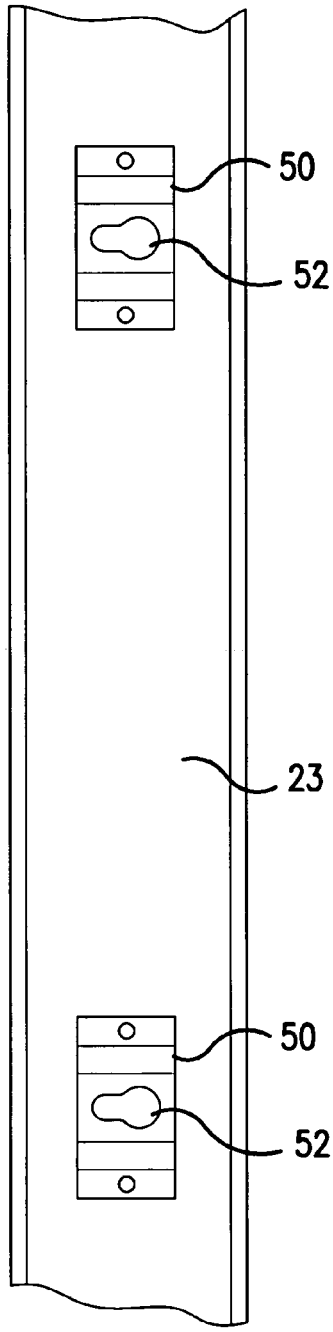
FIG. 4 is a rear view of the embodiment shown in FIG. 3.

FIG. 4 is a rear view of the housing shown in FIG. 3. Two brackets 50 are provided on the back panel 23 for hanging the unit on the wall. Each bracket includes a keyhole 52 for receiving a head of the screw or similar piece of hardware which can be mounted on the wall. The screw head may then placed within the keyhole 52 so that the housing is firmly mounted on the wall. This bracket arrangement could also be replaced with double-sided tape or with holes in the housing.

Figure 5:
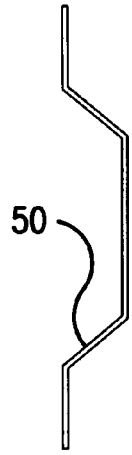
FIG. 5 is a side view of the bracket shown in FIG. 4.

FIG. 5 shows a side view of the bracket 50 as having a flat surface at each end which may be mounted to the back panel using rivets or screws, an angled portion and a flat portion which contains the keyhole 52.

Figure 6:
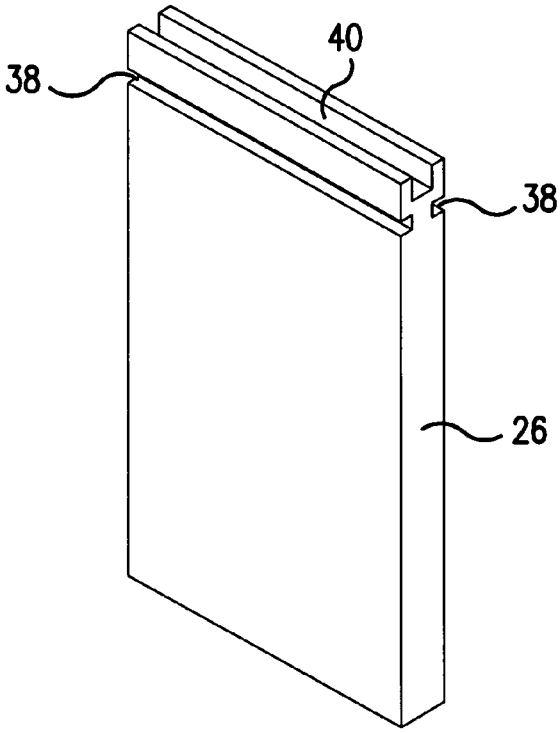
FIG. 6 is a perspective view of an acrylic panel used in the present invention.

FIG. 6 shows an individual panel for receiving an alphanumeric designation. The panel 26 may be made of acrylic or other similar materials onto which the character may be placed. The character may be a number such as for use as a house number or may be a letter of the alphabet. Mixed numbers and letters can be used if the name of the street is included with the street number. Symbols may also be used such as hyphens or other grammatical symbols. Some panels may also be left blank to separate the street number from the street name.

Each panel includes grooves 38 on the front and back edge which are designed to mate with projections 34 and 36 in the housing. One set of projections 34 and 36 are received within each groove 38 to allow the panel to slide. The top edge of the panel 26 has an upper channel 40. The light emitting diodes are arranged so as to extend within this channel so that the light from the LED is most effectively used. By having the LED mounted firmly within the channel, it is possible to slide the panels along the projections without touching the LED's. Thus, the panels may be sold separately and installed by the purchaser in a simple sliding action.

Figure 7:
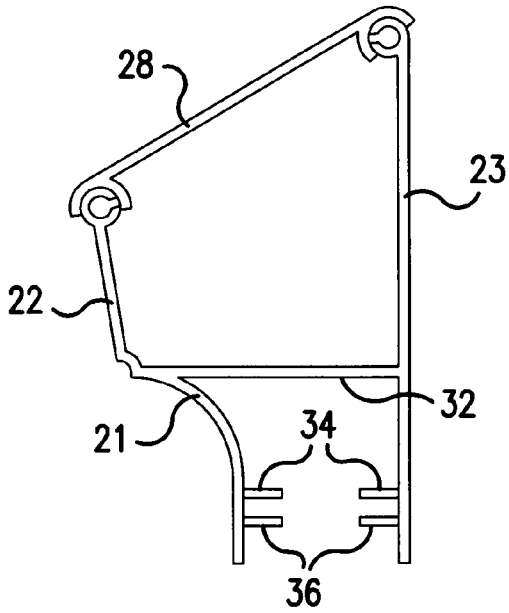
FIG. 7 is an end view of the embodiment shown in FIG. 3.
Figure 9:
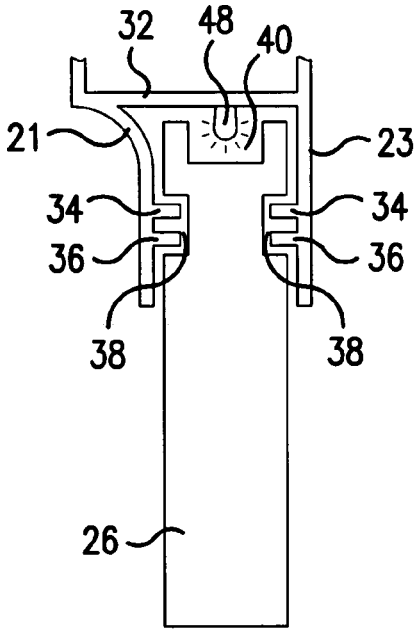
FIG. 9 is an end view of the embodiment shown in FIG. 3 with the acrylic panels inserted.
Figure 10:
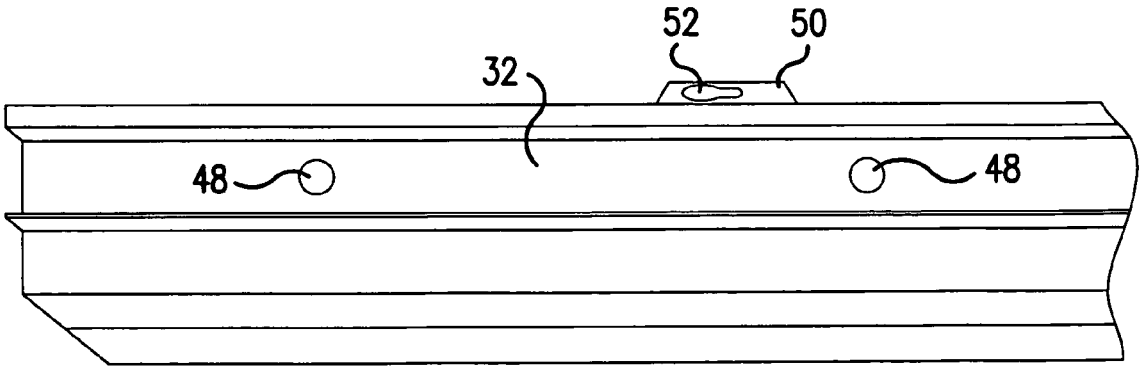
FIG. 10 is an angled bottom view of the embodiment shown in FIG. 3.
Figure 11:
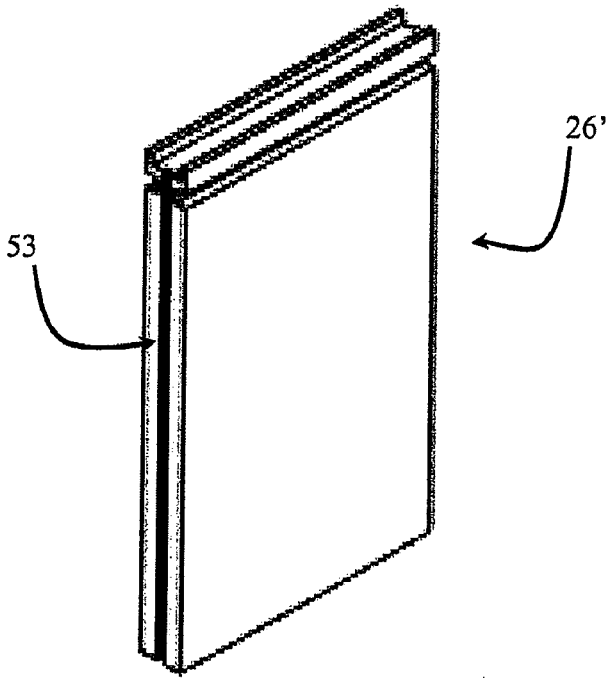
FIG. 11 is a perspective view of another acrylic panel used in the present invention.
Figure 12:
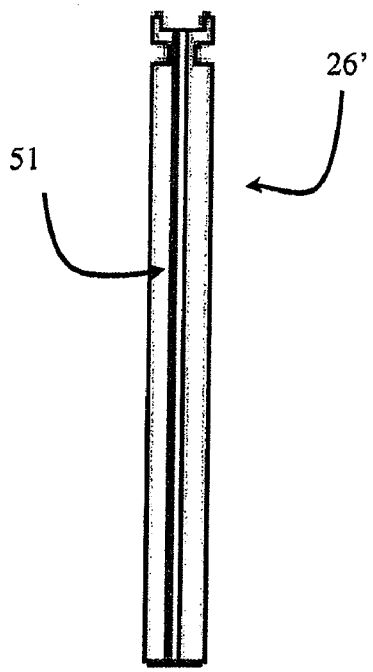
FIG. 12 is an elevation view of the acrylic panel of FIG. 12.

FIG. 7 shows the upper projections 34 and lower projections 36 extending inwardly from the front 21 and back 23 panels near their bottom edge. The light emitting diodes and brackets have been omitted from this drawing for clarity. These two projections interact with the grooves 38 so as to form a sliding track for the panels. This arrangement is best seen in FIG. 9, which shows the lower part of the housing with the acrylic panel 26 in place. The groove 38 receives the projections 34 and 36 to form a sliding track so that the panels may be slid inwardly from one end of the device. When arranged in position, the panels appear to form a single panel with their edges in contact. If desired, as shown in FIGS. 11 and 12, the edges 38' can have a projection 51 and groove or channel system 53 so as to interlock adjacent panels 26' to prevent them from moving.

Since house numbers may vary from 2 digits to 5 digits and in some cases names may be added, the number of panels used can vary greatly. As a result, it is desirable that the housing 22 be arranged in a variable length. Thus, additional sections could be added to the right or left ends of the housing in a simple fashion. Likewise, additional solar panels may be included for providing additional power.

Figure 8:
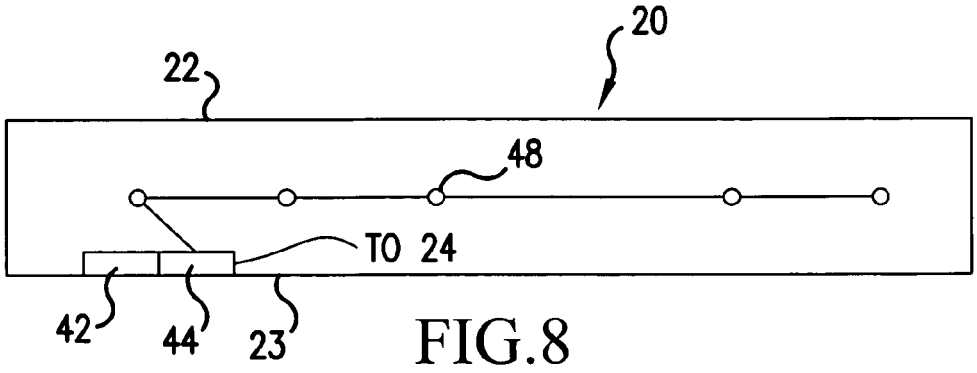
FIG. 8 is a simplified electrical diagram of the embodiment shown in FIG. 3.

FIG. 8 shows an electrical diagram of the display 20. Within the housing 22 is located a chargeable battery 42 which is connected to the lower panels 24 and also connected to electronics package 44 which controls the power distribution. The electronics package is also connected to a series of LEDs 48 which are preferably placed in a longitudinal string with one or more LEDs being placed above each panel. While the embodiment shown in the figure only has one chargeable battery, it is understood that multiple chargeable batteries can be provided. The location of the battery and electronics can vary as desired, but typically are mounted within the housing, for example mounted to the top of the floor 32. In this manner, the weight of the packages are more easily supported. When the light shines on the solar panels, the battery is charged. The electronics package can monitor the power being received from the solar panels. When the received power is less than a predetermined threshold, it would be assumed that it is dark and the LED's will become lit so as to light the display. Alternatively, it would be possible to have a separate photocell for determining when the system should be turned on. It is also possible to include an on/off switch on an end panel or other part of the housing if it is desired for the display not to be lit.

As shown in FIG. 9, the light emitting diode 48 may actually be mounted on floor 32 so as to extend into the channel 40 so that the light from the light emitting diode is more directly and efficiently transmitted into the acrylic panel 26. By efficiently using the light which is produced, the power requirements of the device are lowered so that the display may be properly illuminated without unnecessary wasting of power.

While the panel 26 is shown as sliding onto projections 34 and 36 within the groove 38, other manners of sliding are also possible. Thus, a single rail could be used of a larger size which is just slightly smaller than the size of the groove 38. It would also be possible to include one projection for sliding within the groove 38 and a second projection which extends across the top of the upwardly projecting portions near the top of the panel. This would provide additional stability for the panel.

The housing is shown as having a slanted top which may be at a preferred angle of about 25 degrees for maximum exposure to the sunlight. In addition, this configuration allows rain water to be removed easily. If desired, a sealing material may be placed within the top 28 at the front and back surfaces 21 and 23 to prevent the entrance of water. It is not actually necessary to have a perfectly water tight housing, since the electronic components can be packaged in such a manner as to be waterproof themselves. However, such waterproofing may be desirable to prevent accumulation of water on the panels, for example.

The acrylic panels 26 may be of any size. However, the preferred size is roughly 3 inches wide, 5 and ⅜ inches high and M inch thick. The groove 40 is roughly ¼ inch in height. The grooves 38 are each roughly ⅛ inch in height. The light emitting diodes can emit white light or other colors such as red, green or blue. It is also possible to use changing colors by including multiple lights which are intermittently actuated. An adaptor may be provided to increase the length of the housing and solar panel to accommodate a larger sign.

It is also noted that a single acrylic panel may be used instead of a series of alphanumeric characters on separate panels. However, this will require that the purchaser have the panel separately engraved rather than using the economies of mass production. It is also noted that while the main embodiment is used for a house number display, it will also be possible to use this display for other purposes such as indicating the nature of the business which is attached or for other advertising purposes. For example, a panel could indicate a barber pole for a barber shop, a cocktail glass for a bar, food items for a restaurant or other indicia. It would also be possible to use panels having seasonal decorations for various holidays which could be interchangeable, such as hearts for Valentine's day, clover for St. Patrick's day, rabbits for Easter, flags for Independence Day, witches for Halloween and turkey for Thanksgiving.

Numerous additional modifications and variations of the present invention are possible in light of the above teachings. It is therefore to be understood that within the scope of the appended claims, the invention may be practiced otherwise in a specifically described.

What is claimed:

1. An illuminated sign, comprising:

a housing;

a solar panel forming a top of said housing;

a rechargeable battery mounted within said housing and receiving power from said solar panel to recharge said battery;

a plurality of light emitting diodes contained within said housing and connected to said rechargeable battery for powering said light emitting diodes to produce light;

a sliding channel formed at a bottom of said housing;

at least one acrylic panel including at least one indicia, wherein said at least one acrylic panel interacts with said sliding channel so as to hang down from the housing and receiving light from the light emitting diodes through an upper edge of the panel, said at least one panel includes an upper channel formed along a top surface thereof for receiving light from at least one of said plurality of light emitting diodes, said at least one light emitting diode extends into the upper channel, and said at least one acrylic panel includes a bottom surface that is not supported from below by the housing.

2. The illuminated sign according to claim 1, wherein the at least one acrylic panel has at least one groove in a horizontal direction which interacts with a horizontal projection forming the sliding channel.

3. The illuminated sign according to claim 1, wherein the indicia is an alphanumeric character.

4. The illuminated sign according to claim 1, wherein said sign is turned on when power received from said solar panel falls below a threshold.

5. The illuminated sign according to claim 1, wherein the solar panel is tilted from horizontal.

6. The illuminated sign according to claim 5, wherein the solar panel is tilted approximately 25 degrees to horizontal.

7. The illuminated sign according to claim 1, wherein a plurality of said at least one acrylic panel is provided each with a channel and projection arrangement so that adjoining panels interlock.

8. The illuminated sign according to claim 1, wherein said at least one acrylic panel has the alphanumeric character etched therein so as to make the character opaque.

9. An illuminated sign, comprising:

a housing;

a power system for producing electrical power;

at least one light emitting diode extending downwardly through a floor in said housing; and at least one panel including at least one indicia slidingly mounted below said floor and having a channel on an upper surface thereof into which said light emitting diode extends, wherein said at least one panel includes a bottom surface that is not supported from below by the housing.

10. The illuminated sign according to claim 9, wherein the power system is a rechargeable battery and solar panel.

11. The illuminated sign according to claim 9, wherein said at least one panel further includes at least one horizontal groove for interacting with a channel in said housing.

12. The illuminated sign according to claim 9, wherein the at least one panel is an acrylic panel.

13. The illuminated sign according to claim 9, wherein the indicia is an alphanumeric character.

14. The illuminated sign according to claim 9, wherein a plurality of said at least one panel is provided each with a channel and projection arrangement so that adjoining panels interlock.

* * * * *